US009700854B2

(12) United States Patent
Olson et al.

(10) Patent No.: US 9,700,854 B2
(45) Date of Patent: Jul. 11, 2017

(54) CHEMICAL DILUTION SYSTEM

(71) Applicant: Ecolab USA Inc., Saint Paul, MN (US)

(72) Inventors: Keith E. Olson, Apple Valley, MN (US); Paul R. Kraus, Apple Valley, MN (US); Sherri Tischler, Inver Grove Heights, MN (US); Brandon J. Schirmer, Rosemount, MN (US)

(73) Assignee: Ecolab USA Inc., Saint Paul, MN (US)

( * ) Notice: Subject to any disclaimer, the term of this patent is extended or adjusted under 35 U.S.C. 154(b) by 787 days.

(21) Appl. No.: 13/835,120

(22) Filed: Mar. 15, 2013

(65) Prior Publication Data

US 2014/0261870 A1 Sep. 18, 2014

(51) Int. Cl.

| | |
|---|---|
| ***B01F 5/00*** | (2006.01) |
| ***B01F 5/02*** | (2006.01) |
| ***B01F 5/10*** | (2006.01) |
| ***B01F 13/10*** | (2006.01) |
| ***B01F 15/04*** | (2006.01) |
| ***B01F 1/00*** | (2006.01) |

(52) U.S. Cl.

CPC ..... *B01F 5/0268* (2013.01); *B01F 1/0027* (2013.01); *B01F 5/106* (2013.01); *B01F 13/1055* (2013.01); *B01F 15/0445* (2013.01)

(58) Field of Classification Search

CPC ..... B01F 2015/0221; B01F 15/0222; B01F 15/0226; B01F 1/00; B01F 1/0027; B01F 1/0038; B01F 5/106; B01F 5/0268; B01F 13/1055; B01F 15/0445; A47L 15/4436; Y10T 137/4891

See application file for complete search history.

(56) References Cited

U.S. PATENT DOCUMENTS 3,481,355 A * 12/1969 Watson ..... A61L 2/00 134/57 R
3,727,889 A * 4/1973 Nagel ..... A47L 15/4436 366/162.1

(Continued)

FOREIGN PATENT DOCUMENTS

EP 0278100 A2 8/1988
GB 2379173 A 3/2003

(Continued)

*Primary Examiner* — Timothy L Maust
*Assistant Examiner* — Andrew StClair
(74) *Attorney, Agent, or Firm* — Fredrikson & Byron, P.A.

(57) ABSTRACT

A dilute chemical solution may be prepared in response to a dispense request by combining multiple concentrated chemicals with a diluent. In one example, a target amount of diluent is dispensed into a container until a measured weight of the diluent reaches a target weight. A first concentrated chemical is also dispensed into the container until a measured weight of the first concentrated chemical reaches a target weight. The liquid solution containing the diluent and the first concentrated chemical is withdrawn from the container and applied on a second concentrated chemical that is a solid state product so as to cause the second concentrated chemical to at least partially dissolve and enter the container. In some applications, the first and second concentrated chemicals react with one another to generate an active molecule in the chemical solution that is not present in either of the two concentrated chemicals.

12 Claims, 7 Drawing Sheets

(56) References Cited

U.S. PATENT DOCUMENTS 4,350,186 A * 9/1982 Schalkowsky ..... G01N 1/38 141/102
4,353,482 A 10/1982 Tomlinson et al.
4,629,164 A 12/1986 Sommerville
4,764,019 A 8/1988 Kaminski et al.
4,826,661 A * 5/1989 Copeland ..... A47L 15/4436 134/93
4,964,185 A * 10/1990 Lehn ..... A47L 15/0055 134/93
4,999,124 A 3/1991 Copeland
5,156,194 A 10/1992 von Nehring
5,268,153 A 12/1993 Muller
5,288,145 A 2/1994 Mackey et al.
5,344,231 A 9/1994 Jonsson et al.
5,375,634 A 12/1994 Egger
5,402,834 A 4/1995 Levin et al.
5,409,713 A 4/1995 Lokkesmoe et al.
5,431,200 A 7/1995 Mariotti
5,478,537 A 12/1995 Laughlin et al.
5,515,888 A 5/1996 Graffin
5,607,651 A 3/1997 Thomas et al.
5,681,400 A 10/1997 Brady et al.
5,823,670 A 10/1998 Rushing et al.
6,056,027 A 5/2000 Patterson
6,120,175 A 9/2000 Tewell
6,143,257 A 11/2000 Spriggs et al.
6,149,294 A 11/2000 Jonsson et al.
6,240,953 B1 * 6/2001 Laughlin ..... A47L 15/4436 137/268
6,418,958 B1 * 7/2002 Rossi ..... B01F 13/1019 134/93
6,423,280 B1 7/2002 Tarara et al.
6,793,880 B2 9/2004 Kippenhan, Jr.
6,830,367 B2 12/2004 Peterson et al.
7,090,098 B2 * 8/2006 Livingston ..... G01F 11/46 222/190
7,110,861 B2 9/2006 Nelson et al.
7,201,290 B2 * 4/2007 Mehus ..... B01F 1/0027 222/77
7,300,196 B2 11/2007 Fleig
7,614,410 B2 * 11/2009 Kenowski ..... B08B 9/0325 134/100.1
7,803,321 B2 9/2010 Lark et al.
7,815,072 B2 * 10/2010 Webster ..... G01F 11/46 222/1
7,950,550 B2 * 5/2011 Webster ..... B65D 83/06 222/181.3
8,008,082 B2 * 8/2011 Howland ..... B01F 1/0022 422/403
8,381,681 B2 * 2/2013 Veenstra ..... B01F 1/0027 119/14.08
8,603,408 B2 * 12/2013 Sanville ..... B01F 1/0033 366/177.1
9,022,642 B2 * 5/2015 Broome ..... B01F 1/0033 366/167.1
2005/0201200 A1 9/2005 Fleig
2010/0307534 A1 * 12/2010 Veenstra ..... B01F 1/0027 134/18
2011/0284090 A1 * 11/2011 Popa ..... B01F 1/0027 137/2
2012/0320706 A1 * 12/2012 Sanville ..... B01F 1/0027 366/182.1

FOREIGN PATENT DOCUMENTS

WO 2005070837 A1 8/2005
WO 2011145023 A3 11/2011

* cited by examiner

CHEMICAL DILUTION SYSTEM

TECHNICAL FIELD

This disclosure generally relates to chemical product dilution and, more particularly, to chemical product dilution systems.

BACKGROUND

Automated chemical product dispensers are useful in many different chemical application systems, including cleaning systems relating to food and beverage operations, laundry operations, warewashing operations (e.g., dishwashers), water treatment operations, pool and spa maintenance, as well as other systems, such as agricultural operations. For example, chemical products used in food and beverage operations may include sanitizers, sterilants, cleaners, degreasers, lubricants, etc. Chemical products used in a warewashing or laundry operation may include detergent, de-ionized water, sanitizers, stain removers, rinse agents, etc. Chemical products used in a laundry operation may include detergent, bleaches, stain removers, fabric softeners, etc. Chemical products used in agriculture may include pesticides, herbicides, hydration agents, and fertilizers. Chemical products used in cleaning of medical/surgical instrumentation may include detergent, cleaning products, neutralizers, sanitizers, disinfectants, enzymes, etc. Other chemical products may include, without limitation, glass cleaning chemicals, hard surface cleaners, antimicrobials, germicides, lubricants, water treatment chemicals, rust inhibitors, etc.

Automated chemical product dispensers can reduce labor and chemistry costs by automatically delivering predetermined amounts of chemicals in a proper sequence and in proper amounts, often times in very large quantities or at high speeds. Furthermore, some chemical products can be hazardous in concentrated form; therefore, automated chemical product dispensers reduce the risks of exposure to operators, who may otherwise measure and deliver the chemical products manually. While automated chemical product dispensers can reduce these handling risks, the product dispensers still typically need to be refilled with a concentrated chemical agent on a periodic basis. This is because automated chemical product dispensers generally do not actively combine different chemical compounds but instead merely dilute a single concentrated chemical according to an end user's specifications.

SUMMARY

In general, this disclosure describes devices, systems, and techniques for preparing a dilute chemical solution using multiple concentrated chemicals and a diluent. In some applications, the different concentrated chemicals react with one another to generate an active molecule in the dilute chemical solution that is not present in either of the two concentrated chemicals. For example, two comparatively benign compounds that are easy to ship and handle may be combined on site to generate a third active molecule which, while providing increased performance, requires comparatively more shipping and handling precautions. Although the technique can vary, in one example, a target amount of diluent is dispensed into a container until a measured weight of the diluent reaches the target weight. A first concentrated chemical is also dispensed into the container until a measured weight of the first concentrated chemical reaches a target weight. The liquid solution containing the diluent and the first concentrated chemical is withdrawn from the container and applied on a second concentrated chemical that is a solid state product so as to cause the second concentrated chemical to at least partially dissolve and enter the container. In this manner, the first concentrated chemical is combined with the second concentrated chemical and the diluent to generate the dilute chemical solution.

In one example, a chemical dilution system is described that includes a first reservoir, a second reservoir, a container, a weighing device, a fluid delivery system, and a controller. The first reservoir contains a first concentrated chemical. The second reservoir contains a second concentrated chemical, where the second concentrated chemical is a solid state product and is different than the first concentrated chemical. The container is configured to receive a target amount of a diluent required to prepare a diluted chemical solution. The weighing device is positioned to obtain container weight information concerning a weight of the container and any contents thereof. The fluid delivery system is configured to extract a liquid solution from the container and apply the liquid solution on at least the second concentrated chemical so as to cause the second concentrated chemical to at least partially dissolve and enter the container. The controller is configured to receive a dispense request requesting preparation of a requested amount of the diluted chemical solution, determine the target amount of the diluent required to prepare the diluted chemical solution, determine a target weight of the first concentrated chemical required to prepare the diluted chemical solution, and determine a target weight of the second concentrated chemical required to prepare the diluted chemical solution. The controller is also configured to control addition of the first concentrated chemical to the container based on the container weight information until the target weight of the first concentrated chemical is in the container and control application of the liquid solution on the second concentrated chemical based on the container weight information until the target weight of the second concentrated chemical is in the container.

In another example, a method is described that includes dispensing a diluent into a container until a measured weight of the diluent in the container reaches a target weight for the diluent and dispensing a first concentrated chemical into the container containing the diluent until a measured weight of the first concentrated chemical in the container reaches a target weight for the first concentrated chemical. The example method also includes withdrawing a liquid solution containing the diluent and the first concentrated chemical from the container and applying the liquid solution on a second concentrated chemical that is a solid state product and is different than the first concentrated chemical so as to cause the second concentrated chemical to at least partially dissolve and enter the container. In addition, the method includes applying the liquid solution from the container on the second concentrated chemical until a measured weight of the second concentrated chemical in the container reaches a target weight for the second concentrated chemical.

The details of one or more examples are set forth in the accompanying drawings and the description below. Other features, objects, and advantages will be apparent from the description and drawings, and from the claims.

DETAILED DESCRIPTION

Figure 1:
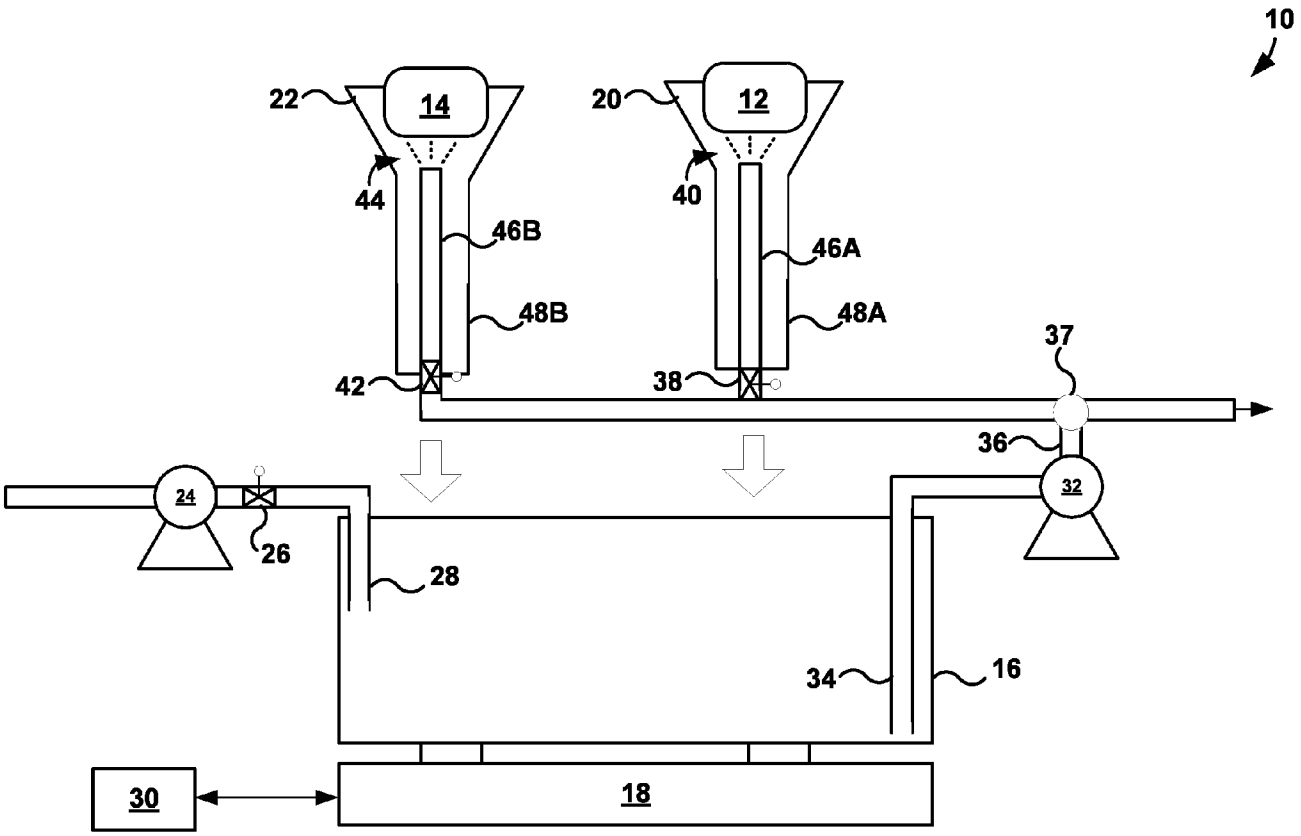
FIG. 1 is an illustration of an example chemical dilution system that may be used to prepare a dilute chemical solution using multiple concentrated chemicals.

A variety of chemicals are provided to end users in concentrated form to reduce the weight and volume of the chemicals during shipping and storage. Once delivered to a location of intended use, however, a concentrated chemical is combined with a diluent such as water to produce a diluted chemical solution, which may be referred to as a use solution. Depending on the composition of the concentrated chemical, the use solution can be used for any number of applications such as hard surface sanitation, food and beverage operations, laundry operations, warewashing operations, water treatment operations, pool and spa maintenance, agricultural operations, and the like.

Concentrated chemicals provided for end use dilution have historically been supplied as single product chemicals that can be mixed with a diluent to form a use solution. For example, concentrated chemicals comprised of a single chemical compound or combination of chemical compounds have been provided as a solid block which, when sprayed with diluent, dissolve to form the use solution. In these systems, an end user only needs to apply the diluent to the solid block to generate the use solution.

With increasing awareness of the health, safety, and environmental impacts of transporting, storing, and handling concentrated chemicals, there is a drive to minimize the harmful side effects of certain chemicals without decreasing the efficacy of a use solution formed from such chemicals. For example, if an active chemical compound in a use solution could be generated on-site at a point of dilution by reacting two comparatively benign chemical precursors, the handling risks associated with the active chemical compound could be mitigated without sacrificing the efficacy of the use solution.

In general, this disclosure describes chemical dilution systems and techniques that utilize at least two concentrated chemicals of different composition. In some examples, a user requests preparation of a diluted chemical solution and, in response to the request, the system determines an amount of diluent, an amount of a first concentrated chemical, and an amount of a second concentrated chemical required to generate the requested solution. The system then controls addition of the diluent to a container until the amount of diluent in the container reaches a target weight. The system may then further control addition of the first concentrated chemical to the container until the amount of the first concentrated chemical in the container reaches a target weight. A portion of the contents of the container, for example containing the diluent and the first concentrated chemical, are extracted from the container and applied on the second concentrated chemical. This can cause the second concentrated chemical to dissolve and/or disintegrate and enter the container. The system can apply the contents of the container on the second concentrated chemical until the amount of the second concentrated chemical reaches a target weight. In this way, the system can generate a use solution from separate concentrated chemical sources. Depending on the composition of the concentrated chemicals, the chemicals may or may not reactively combine to form an active chemical compound in the use solution that is different than the chemical compounds in either of concentrated chemical sources.

Independent of the number of concentrated chemicals utilized by the chemical dilution system, the system may apply a liquid solution containing diluent on a solid phase concentrated chemical until a measured weight of the liquid solution containing the concentrated chemical equals a target weight for the chemical. The system may include a pick-up conduit extending into a container containing the liquid solution so that the pick-up conduit is submerged to an increasing extent as the container fills with liquid. In such applications, the system may adjust the measured weight of the liquid solution to account for an amount of fluid displaced by the pick-up conduit to help prevent inaccuracies in the preparation of the dilute chemical solution.

FIG. 1 is an illustration of an example chemical dilution system 10, which may also be referred to as a chemical dispensing system, that prepares a requested dilute chemical solution from a first concentrated chemical 12 and a second concentrated chemical 14. System 10 includes a container 16 into which the requested dilute chemical solution is prepared and a weighing device 18 that measures the weight of the container and its contents. System 10 also includes a first reservoir 20 that houses first concentrated chemical 12 and a second reservoir 22 that houses second concentrated chemical 14. In the example of FIG. 1, first concentrated chemical 12 and second concentrated chemical 14 are solid phase products, such as solid blocks, pellets, tablets, cast products, extruded products, or other products that are firm and stable in shape. In other examples (e.g., FIGS. 2 and 3), first concentrated chemical 12 and/or second concentrated chemical 14 is a liquid phase product that can be dispensed into container 16.

To fill container 16 with a target amount of diluent to generate a dilute chemical solution, chemical dilution system 10 includes a diluent pump 24 and an electronically actuatable diluent delivery valve 26 in fluid communication with a diluent delivery conduct 28. Under the control of controller 30, diluent pump 24 is activated and diluent delivery valve 26 opened in response to a request to generate a dilute chemical solution to fill container 18 with a target amount of diluent. The diluent is typically water (e.g., deionized water), although other liquid compounds that are desired to form a majority percentage of a dilute chemical solution can be used instead of water. In addition, although chemical dilution system 10 in the example of FIG. 1 includes diluent pump 24 and diluent delivery valve 26 to control addition of diluent to container 16, other fluid control systems are possible. For example, when water is used as a diluent, the water may be delivered directly from a pressurized water main, for example through diluent delivery valve 26, without utilizing diluent pump 24.

Chemical dilution system 10 includes a fluid delivery system that is configured to draw liquid from container 16 and apply the liquid on first concentrated chemical 12 and second concentrated chemical 14. The fluid delivery system includes a fluid delivery pump 32 that draws liquid from container 16 via a pick-up conduit 34. Pick-up conduit 34 is connected to a suction side of fluid delivery pump 32 and extends down into container 16 so that, as the container is filled to an increasing extent (e.g., height) with liquid, the pick-up conduit is submerged to an increasing extent. Fluid delivery pump 32 is fluidly connected on a discharge side to a conduit 36 that is configured to apply liquid withdrawn from container 16 on first concentrated chemical 12 and second concentrated chemical 14. A first electronically actuatable valve 38 is fluidly connected to conduit 36 and positioned to control liquid flow between fluid delivery pump 32 and a first spray nozzle 40. A second electronically actuatable valve 42 is fluidly connected to conduit 36 and positioned to control liquid flow between fluid delivery pump 32 and a second spray nozzle 44. First spray nozzle 40 and second spray nozzle 44 are designed to spray liquid on and over first concentrated chemical 12 and second concentrated chemical 14, respectively, so as to cause the chemicals to dissolve and/or disintegrate (a removal process collectively referred to herein as "dissolving") and enter container 16. It should be appreciated that the fluid delivery system shown in FIG. 1 is merely one example, and fluid delivery systems have other configurations that can be used without departing from the scope of the disclosure.

For example, although first spray nozzle 40 and second spray nozzle 44 are illustrated in FIG. 1 as spraying first concentrated chemical 12 and second concentrated chemical 14, respectively, in an upward direction, the nozzles may be arranged to spray the chemicals from the top in a downwardly direction, from the side(s), or in any other orientation. As another example, first reservoir 20 and/or second reservoir 22 may have a valve positioned to control fluid flow through an outlet of the reservoir. To dispense concentrated chemical, the reservoir outlet may be closed and the reservoir filled with diluent so that the concentrated chemical is surrounded (e.g., partially or fully) with diluent. After a residence period in which the concentrated chemical is allowed to dissolve in the diluent surrounding the chemical, the valve may be opened to discharge the contents into container 16. The process can be repeated until a target amount of the chemical dissolves and enters container 16.

In general, container 16 is a reservoir that holds liquid. During preparation of a dilute chemical solution, container 16 may initially hold diluent only. As diluent is withdrawn from container 16 and applied sequentially to first concentrated chemical 12 and/or second concentrated chemical 14, the container may hold progressively increasing concentrations of the first concentrated chemical 12 and/or second concentrated chemical 14 until the container holds diluent along with a target amount of first concentrated chemical 12 and a target amount of the second concentrated chemical 14. In applications where the first concentrated chemical 12 and second concentrated chemical 14 react with one another, container 16 may hold diluent and a reaction product of the first concentrated chemical 12 and second concentrated chemical 14.

Controller 30 manages the overall operation of chemical dilution system 10 including initiating and controlling operation of dispensing cycles, controlling the various valves and pumps in the system, receiving and processing signals from weighing device 18, and the like. Although not illustrated in FIG. 1, controller 30 may be communicatively coupled to the various pumps and valves in chemical dilution system 10 so as to send and receive electronic control signals and information between controller 30 and the communicatively coupled components.

During operation, controller 30 may receive a dispense request requesting preparation of a requested amount of a diluted chemical solution. The dispense request may specify a requested amount (e.g., volume or weight) of dilute chemical solution to be prepared, a requested concentration of a chemical product in the diluted chemical solution, and/or a requested compositional formulation for the diluted chemical solution. From this information, controller 30 may determine a target weight of the diluent required to prepare the requested dilute chemical solution, determine a target weight of the first concentrated chemical 12 required to prepare the dilute chemical solution, and determine a target weight of the second concentrated chemical 14 required to prepare the dilute chemical solution. In some examples, controller 30 references formulation information stored in a memory associated with the controller to determine a target amount of first concentrated chemical 12 and a target amount of second concentrated chemical 14 needed to prepare the requested dilute chemical solution. The formulation information may be stored in the form of look-up tables, equations, ratios, or any other suitable form. Controller 30 can then control chemical dilution system 10 to prepare the requested dilute chemical solution based on the determined target weights.

As one example, a dispense request may request preparation of one liter (1000 grams assuming a density of one gram per liter) of a dilute chemical solution that contains 5 weight percent of first concentrated chemical 12 and 3 weight percent of second concentrated chemical 14. If the first and second concentrated chemicals do not react with one another, controller 30 may determine that a target weight of diluent is 920 grams, a target weight of first concentrated chemical 12 is 50 grams, and a target weight of second concentrated chemical 14 is 30 grams to achieve this dispense request.

To prepare the requested dilute chemical solution according to this example, controller 30 can activate diluent pump 24 and open valve 26 to fill container 16 with diluent until feedback from weighing device 34 indicates that 920 grams of diluent are in the container. At this point, controller 30 deactivates pump 24 and closes valve 26. Controller 30 can subsequently activate fluid delivery pump 32 and open either first electronically controllable valve 38 and/or second electronically controllable valve 42. When first electronically controllable valve 38 is open, liquid is drawn through pick-up conduit 34 from container 16, pressurized by fluid delivery pump 32, and sprayed via first spray nozzle 40 onto first concentrated chemical 12. As liquid from container 16 is sprayed on first concentrated chemical 12, the chemical at least partially dissolves and enters (e.g., drops down into) the liquid in container 16. Controller 30 controls application of fluid on first concentrated chemical 12, e.g., until feedback from weighing device 34 indicates that the contents of container 16 weight 970 grams (920 grams of diluent and 50 grams of the first concentrated chemical). At this point, controller 30 can close first electronically controllable valve 38 and close second electronically controllable valve 42 so as to deliver liquid (e.g., containing diluent and first concentrated chemical 16) from container 16 onto second concentrated chemical 14 via second spray nozzle 44. Controller 30 controls application of fluid on second concentrated chemical 14, e.g., until feedback from weighing device 34 indicates that the contents of container 16 weight 1000 grams (920 grams of diluent, 50 grams of the first concentrated chemical, and 30 grams of the second concentrated chemical).

As another example, a dispense request may request preparation of one liter (1000 grams assuming a density of one gram per liter) of a dilute chemical solution that contains 5 weight percent of an active chemical compound, where the active chemical compound is formed by reacting one mole of first concentrated chemical 12 with two mole of second concentrated chemical 14. Controller 30 may determine that a target weight of the active chemical compound is 50 grams. With reference to formulation information stored in memory, controller 30 may further determine a target amount of first concentrated chemical 12 and a target amount of second concentrated chemical 14 required to generate the 50 grams of active chemical compound. For purposes of illustration only, assume that the target amount of first concentrated chemical 12 required to generate the 50 grams of active chemical compound is 22 grams and the target amount of second concentrated chemical 14 is 45 grams. Based on this determination, controller 30 determines that a target weight of diluent for preparing the requested dilute chemical solution is 933 grams (1000 grams−22 grams−45 grams).

To prepare the requested dilute chemical solution according to this example, controller 30 can activate diluent pump 24 and open valve 26 to fill container 16 with diluent until feedback from weighing device 34 indicates that 933 grams of diluent are in the container. At this point, controller 30 deactivates pump 24 and closes valve 26. Controller 30 can subsequently activate fluid delivery pump 32 and open either first electronically controllable valve 38 and/or second electronically controllable valve 42. When first electronically controllable valve 38 is open, liquid is drawn through pick-up conduit 34 from container 16, pressurized by fluid delivery pump 32, and sprayed via first spray nozzle 40 onto first concentrated chemical 12. As liquid from container 16 is sprayed on first concentrated chemical 12, the chemical at least partially dissolves and enters (e.g., drops down into) the liquid in container 16. Controller 30 controls application of fluid on first concentrated chemical 12, e.g., until feedback from weighing device 34 indicates that the contents of container 16 weight 955 grams (933 grams of diluent and 22 grams of the first concentrated chemical). At this point, controller 30 can close first electronically controllable valve 38 and close second electronically controllable valve 42 so as to deliver liquid (e.g., containing diluent and first concentrated chemical 16) from container 16 onto second concentrated chemical 14 via second spray nozzle 44.

Controller 30 can control application of fluid on second concentrated chemical 14, e.g., until feedback from weighing device 34 indicates that the contents of container 16 weight 1000 grams (933 grams of diluent, 22 grams of the first concentrated chemical, and 45 grams of the second concentrated chemical). In practice, as liquid solution containing first concentrated chemical 12 is applied on second concentrated chemical 14, the two chemicals may react to produce a reaction product that includes the desired active chemical compound for the dilute chemical solution. Therefore, the weight measured by weighing device 18 and designed as being the weight of second concentrated chemical 14 may, in fact, be weight of a reaction product of the second concentrated chemical.

In some examples, a delivery conduit (not illustrated on FIG. 3) is fluidly connected to a discharge side of fluid delivery pump 32 and configured to deliver the contents of container 16 to a secondary container. Access to the delivery conduit may be controlled by a three-way valve 37 communicatively coupled to controller 30. During preparation of a requested dilute chemical solution, controller 30 can add a first target amount of diluent, a target amount of first concentrated chemical 12, and a target amount of second concentrated chemical 14 to container 16. Controller 30 can activate fluid delivery pump 32 to transfer the contents of container 16 to the secondary container. Thereafter, controller 30 can control addition of a second target amount of diluent to container 16 and subsequently activate fluid delivery pump 32 to transfer the second target amount of diluent to the secondary container, thereby further diluting the dilute chemical solution in the secondary container. In instances in which the second target amount of diluent is the same as the first target amount of diluent, the process can double dilute the concentration of first concentrated chemical 12 and second concentrated chemical 14 in the secondary container. Of course, the second target amount of diluent may be less than the first target amount to create a lesser dilution in the secondary container or additional target amounts of diluent (e.g., a third target amount, a fourth target amount, or more) may be added to the secondary container to create a greater dilution (e.g., a triple dilution, etc.).

Controlling chemical dilution system 10 to add additional amounts of diluent to a secondary container may be useful for creating chemical solutions that are highly dilute. For example, some dilute chemical solutions may contain such a small amount of first concentrated chemical 12 and/or second concentrated chemical 14 that it is difficult for weighing device 18 to accurately measure addition of the chemicals to container 16 at the final intended concentration. However, by first creating a solution that has higher concentrations of first concentrated chemical 12 and/or second concentrated chemical 14 and then subsequently diluting the solution in a secondary container, weighing device 18 may more accurately measure additions of the chemicals for the final dilute chemical solution.

Independent of the specific amount and composition requested in a dispense request, controller 30 may receive a dispense request entered by a user and/or electronically stored in a memory. For example, a user may enter a dispense request specifying the amount of dilute chemical solution to be prepared and the concentration of the requested solution. As another example, controller 30 may store a programmed sequence of dispense requests to be prepared at certain times of day or in a predefined sequence. As another example, a dispense request may be automatically generated when it is determined that more dilute chemical solution is needed. For example, if dilute chemical solution is being drawn out of container 16 on an as needed basis, an out-of-product sensor may detect when the container is empty or nearing empty. The out-of-product sensor may then automatically generate a dispense request. Similarly, if container 16 is drawn in known quantities, a dispense request may be automatically generated after a certain number of draws known to empty the container have occurred.

Controller 30 may also store one or more dispenser settings corresponding to preparations of multiple dilute chemical solutions, where each dilute chemical solution has a different formulation than each other dilute chemical solution. For example, settings required to prepare dilute chemical solutions of different volumes/concentrations/compositions may be stored for one or more chemical products including detergent, sanitizer, rinse agent, bleach, disinfectant, etc. Also, multiple different target concentrations may be stored for each cleaning agent depending upon the items that the dilute chemical solution will be cleaning.

For example, cleaning of medical instrumentation may require a higher concentration of disinfectant than cleaning of dishware, etc.

Controller 30 may perform other control and monitoring functions within chemical dilution system 10. As one example, controller 30 may initiate a timer upon preparing a dilute chemical solution that counts the amount of time elapsed since the solution was prepared. With reference to time limits stored in memory, controller 30 may provide a user alert when the elapsed time has exceeded a threshold amount of time. In some examples, controller 30 controls chemical dilution system 10 to discharge and discard the contents of container 16 when the elapsed time has exceeded the threshold amount of time. In these examples, controller 30 may also automatically generate a fresh batch of dilute chemical solution in container 16 after discarding the prior batch. Different time limits may be stored in memory for different dilute chemical solutions. Example time limits may be, but are not limited to, 2 hours, 4 hours, 8 hours, 12 hours, 1 day, and 1 week. Discarding old dilute chemical solutions on a periodic basis may be helpful, e.g., to prevent bacterial growth in a solution and to ensure that desired chemistries in the solution are active, among other reasons.

In use, first concentrated chemical 12 is loaded into first reservoir 20 and second concentrated chemical 14 is loaded in second reservoir 22. First concentrated chemical 12 and second concentrated chemical 14 may each be considered "concentrated" in that a concentration of a chemical that makes the product function for its intended purpose is higher in the product than when diluted in container 16. First concentrated chemical 12 and second concentrated chemical 14 are selected based on the intended application of the dilute chemical solution generated from the chemicals. In some examples, first concentrated chemical 12 includes an oxygen catalyst and second concentrated chemical 14 includes an oxygen source, such as a percarbonate, a perborate, or a peroxide (e.g., hydrogen peroxide). First concentrated chemical 12 and second concentrated chemical 14 may or may not react with one another, e.g., to form a molecule different than that contained in either the first concentrated chemical or the second concentrated chemical.

In general, first concentrated chemical 12 contains a different chemical compound than second concentrated chemical 14, although in some examples, first concentrated chemical 12 and second concentrated chemical 14 may be the same chemical (e.g., in different concentrations, bound with different preservatives for different shelf lives, or the like). In addition, although chemical dilution system 10 in FIG. 1 is illustrated as having two concentrated chemicals, in other applications, the system may have fewer concentrated chemicals (i.e., a single concentrated chemical) or more concentrated chemicals (e.g., three, four, or more). If first concentrated chemical 12 and second concentrated chemical 14 are packaged in a product capsule or other product packaging, that packaging may include appropriately placed openings so that the chemical product may be exposed to the liquid spray and so that dissolved chemical may exit the product capsule.

First reservoir 20 and second reservoir 22 contain first concentrated chemical 12 and second concentrated chemical 14, respectively. In the example of FIG. 1 where first concentrated chemical 12 and second concentrated chemical 14 are solid phase materials, each reservoir has an inlet 46A, 46B and an outlet 48A, 48B. During operation, liquid solution withdrawn from container 16 is pumped through inlet 46A, 46B and may exit through a spray nozzle so as to spray on first concentrated chemical 12 and second concentrated chemical 14. Outlet 48A, 48B is positioned over container 16 so that liquid solution sprayed on first concentrated chemical 12 and second concentrated chemical 14 drains back down into the container, along with any concentrated chemical that may dissolve.

Once a dilute chemical solution is generated in container 16, the solution may be discharged from the container for a suitable application. In some examples, a delivery conduit (not illustrated on FIG. 1) is fluidly connected to a discharge side of fluid delivery pump 32 and configured to deliver the solution to an intended discharge location. The intended discharge location may be a machine that directly utilizes the solution (e.g., a laundry machine, a warewash machine, a surgical instrument cleaner, an automobile wash). Alternatively, the intended discharge location may be a dispenser that dispenses the solution into a portable container.

In still other examples, container 16 may itself be removable from chemical dilution system 10 so that a user can manually move the container and any diluted chemical solution therein to an intended application location. For example, container 16 may be a bucket (e.g., mop bucket), pail, spray bottle, or other container that a human user can remove from chemical dilution system 10 and manually move from one physical location to another physical location without the aid of a mechanized lifting device. In accordance with these examples, the user can place a portable container directly into chemical dilution system 10, enter a dispense request to generate a dilute chemical solution in the portable container, and then remove the portable container from the system. The user may or may not insert an applicator into the portable container (e.g., a spray bottle trigger mechanism) after removing the container from the system to prepare the container to dispense dilute chemical at an intended application location.

Components described as pumps (24, 32) may be any suitable fluid pressurization device such as a direct lift pump, positive displacement pump, velocity pump, buoyancy pump and/or gravity pump or any combination thereof. In one example, one or both of pumps (24, 32) is a squeeze pump that squeezes a fluid pathway in a controlled manner, e.g., such as a peristaltic pump, to progressively move fluid from a suction end to a delivery end of the pump.

In general, components described as valves (26, 37, 38, 42) may be any device that regulates the flow of a fluid by opening or closing fluid communication through a fluid conduit. In various examples, a valve may be a diaphragm valve, ball valve, check valve, gate valve, slide valve, piston valve, rotary valve, shuttle valve, and/or combinations thereof. Each valve may include an actuator, such as a pneumatic actuator, electrical actuator, hydraulic actuator, or the like. For example, each valve may include a solenoid, piezoelectric element, or similar feature to convent electrical energy received from controller 30 into mechanical energy to mechanically open and close the valve. Each valve may include a limit switch, proximity sensor, or other electromechanical device to provide confirmation that the valve is in an open or closed position, the signals of which are transmitted back to controller 30.

Conduits in chemical dilution system 10 may be pipes or segments of tubing that allow liquid to be conveyed from one location to another location in the system. The material used to fabricate the conduits should be chemically compatible with the liquid to be conveyed and, in various examples, may be steel, stainless steel, or a polymer (e.g., polypropylene, polyethylene).

Weighing device 18 is positioned to measure the weight of container 16 and its contents and to communicate the container weight information to controller 30. Container 16 and weighing device 16 may be surrounded by an enclosure (not illustrated), which may help to prevent contaminants from entering the container while preparing and/or storing the dilute chemical solution. In general, weighing device 18 may include any type of weighing scale capable of determining the weight or mass of an object. For example, weighing device 18 may be implemented using one or more load cells, strain gauges, a spring scale, an analytical scale, a hydraulic scale, a pneumatic scale, or any other device or apparatus capable of measuring the weight or mass of an object.

In some examples, weighing device 18 comprises one or more load beams positioned under container 16 to measure a weight of the container and its contents. For example, a two load beam weighing device could obtain the weight of the container and the liquid solution therein and provide analog strain signals to a circuit board that conditions and converts these measurements into a single mass value. Such a dual beam layout may be arranged so that a drain could be placed in the bottom of or on the lower portion of one of the sidewalls of container 16. In this example, container 16 may be sloped towards the drain to allow gravity to dispense the liquid out of the container.

Controller 30 is communicatively coupled, e.g., via wired or wireless connections, to the various components of chemical dilution system 10, such as pumps (24, 32), valves (26, 38, 42), and weighing device 18. Controller 30 may include a processor and memory. The memory may store software and data used or generated by controller 30 to perform the functions attributed to the controller and chemical dilution system 10 herein.

Figure 4:
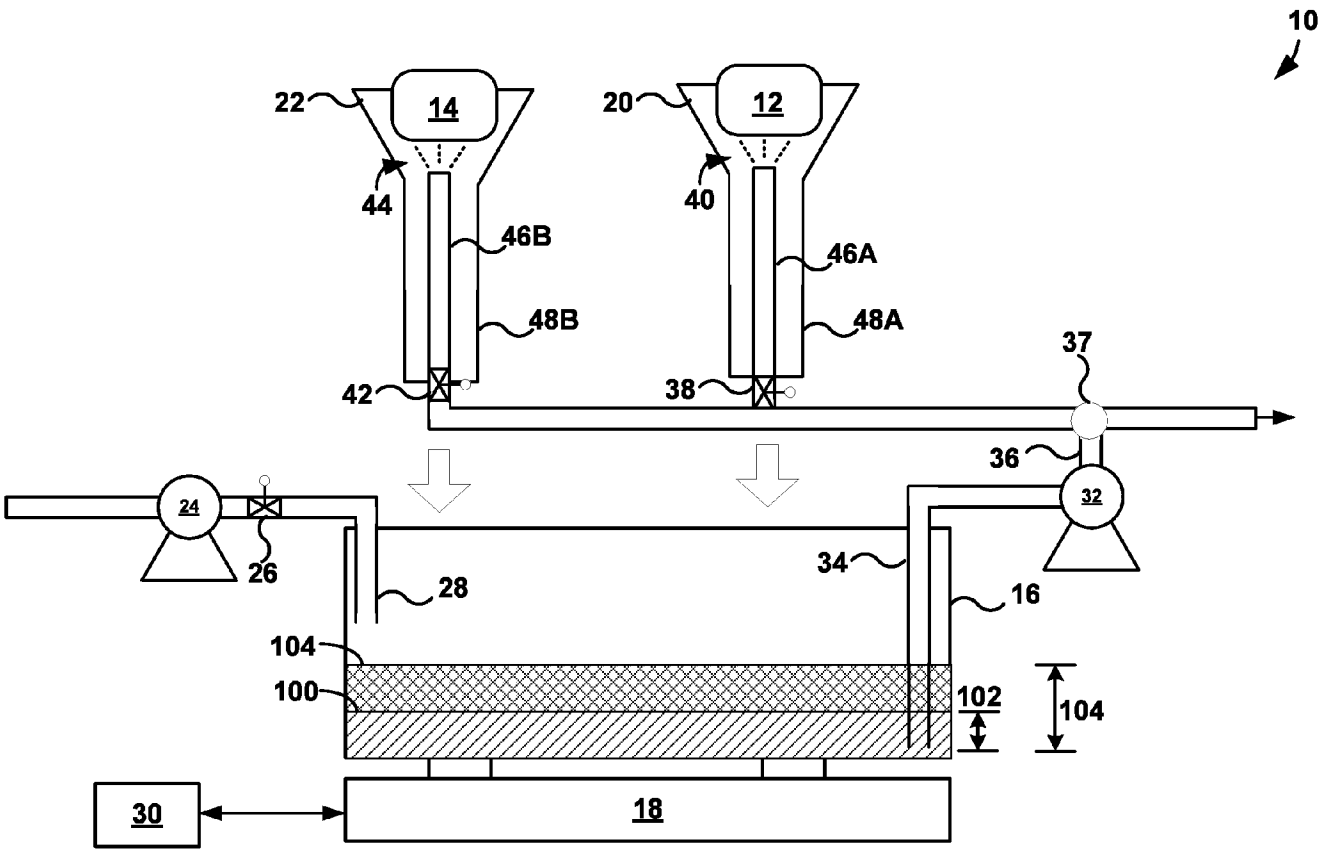
FIG. 4 is an illustration of different container liquid heights that may be observed during operation of the example chemical dilution system of FIG. 1.
Figure 5:
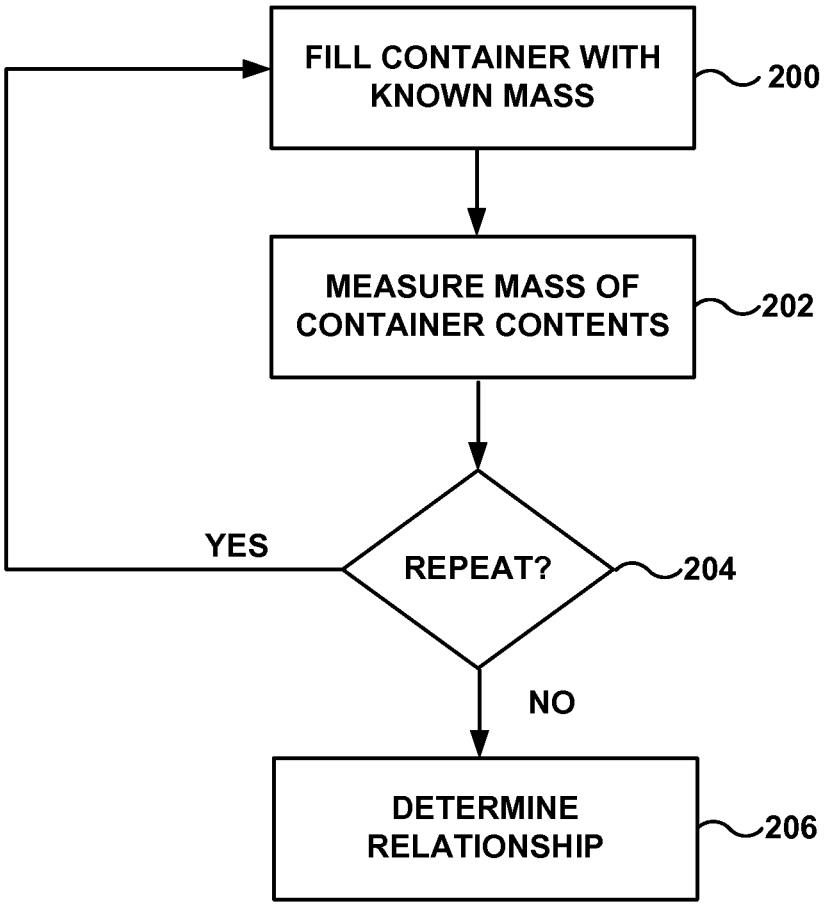
FIG. 5 is a block flow diagram of an example technique for calibrating a chemical dilution system.

For example, as described in greater detail with respect to FIGS. 4 and 5, controller 30 may store calibration information so as to take the weight of the empty container and/or other objects affecting the container weight information into account when determining the weight of the liquid solution in the container. Controller 30 may also store formulation information that is referenced in response to a dispense request so as to determine a target weight of diluent, a target weight of first concentrated chemical 12, and a target weight of second concentrated chemical 14 for adding to container 16. Controller 30 may control when and how much diluent is dispensed in container 16, when and how much diluent is applied to first concentrated chemical 12, and when and how much diluent is applied to second concentrated chemical 14.

Figure 2:
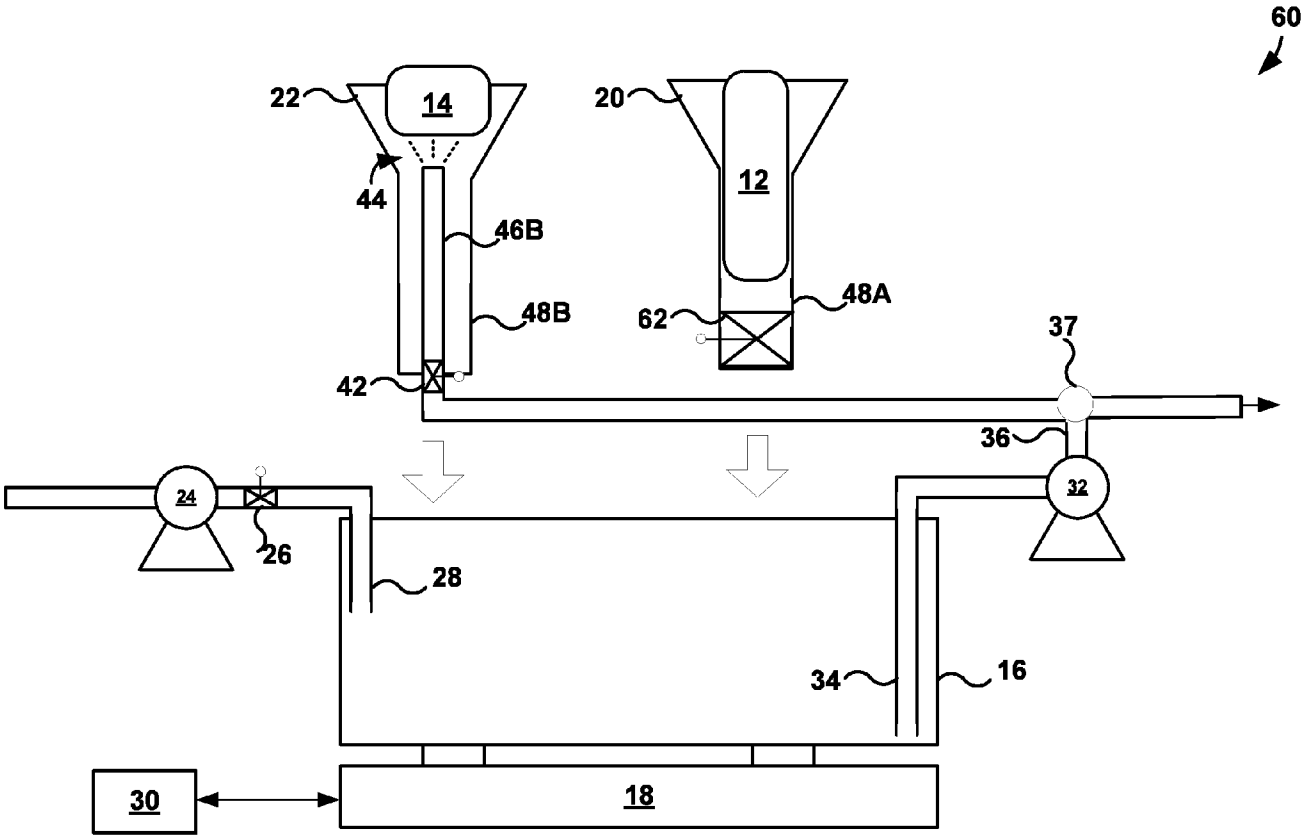
FIG. 2 is an illustration of another example chemical dilution system that may be used to prepare a dilute chemical solution using multiple concentrated chemicals.

FIG. 2 is a diagram of another example chemical dilution system 60 that prepares a requested dilute chemical solution from first concentrated chemical 12 and second concentrated chemical 14. Example chemical dilution system 60 in FIG. 2 is the same as example system 10 in FIG. 1 except that first concentrated chemical 12 is a liquid phase product rather than a solid phase product. When first concentrated chemical 12 is provided as a liquid product, first reservoir 20 is a reservoir that contains a liquid rather than a solid and may be, e.g., a tank, a tote, or a bottle.

First reservoir 20 in chemical dilution system 60 includes an electronically controllable valve 62 positioned to control liquid flow out of first reservoir 20 via outlet 48A. Valve 62, which may be any of the types of valves discussed above with respect to FIG. 1, can be communicatively coupled to controller 30. In response to receiving a dispense request, controller 30 can control valve 62 to dispense a target amount of first concentrated chemical 12 into container 16. For example, when controller 30 opens valve 62, the force of gravity may cause first concentrated chemical 12 to dispense into container 16. Controller 30 can hold valve 62 open until feedback from weighing device 18 indicates that a target amount of first concentrated chemical 12 has entered container 16, at which point the controller closes the valve. Although FIG. 2 illustrates one example configuration for controlling addition of a liquid chemical to container 16, it should be appreciated that other configurations are possible. For example, chemical dilution system 60 may include a pump which, operating under the control of controller 30, pumps first concentrated chemical 12 from first reservoir 20 to container 16.

To prepare a requested dilute chemical solution, controller 30 can activate diluent pump 24 and open valve 26 to fill container 16 with diluent until feedback from weighing device 18 indicates that a target amount of diluent is in the container. At this point, controller 30 deactivates pump 24 and closes valve 26. Depending on the instructions stored for operation of controller 30, the controller may either control addition of first concentrated chemical 12 to container 16 so as to generate a liquid solution of diluent and the first concentrated chemical or control addition of second concentrated chemical 14 to the container so as to generate a liquid solution of diluent and the second concentrated chemical.

In one example, controller 30 opens electronically controllable valve 62 to dispense first concentrated chemical 12 into container 16. Controller 30 controls addition of first concentrated chemical 12 to container 16, e.g., until feedback from weighing device 18 indicates that a target amount of the first concentrated chemical has been added to the container. Controller 30 can close electronically controllable valve 62 when the target amount of first concentrated chemical 12 is reached. Controller 30 can subsequently activate fluid delivery pump 32 and open electronically controllable valve 42 to apply liquid solution containing both diluent and first concentrated chemical 12 on second concentrated chemical 14. As liquid from container 16 is sprayed on second concentrated chemical 14, the chemical at least partially dissolves and enters (e.g., drops down into) the liquid in container 16. Controller 30 controls application of fluid on second concentrated chemical 14, e.g., until feedback from weighing device 18 indicates that a target amount of the second concentrated chemical has entered the container.

In another example, controller 30 activates fluid delivery pump 32 and opens electronically controllable valve 42 to apply liquid solution on second concentrated chemical 14 before first concentrated chemical 12 is added to the container. Controller 30 controls application of fluid on second concentrated chemical 14, e.g., until feedback from weighing device 18 indicates that a target amount of the second concentrated chemical has entered the container. At this point, controller 30 can open electronically controllable valve 62 to dispense first concentrated chemical 62 into container 16 containing diluent and second concentrated chemical 12. Controller 30 controls addition of first concentrated chemical 12 to container 16, e.g., until feedback from weighing device 18 indicates that a target amount of the first concentrated chemical has been added to the container. Controller 30 can close electronically controllable valve 62 when the target amount of first concentrated chemical 12 is reached.

Controlling the order in which diluent, first concentrated chemical 12, and second concentrated chemical 12 are added to container 16 may be useful to ensure proper formulation of a dilute chemical solution formed via system 60. For example, when first concentrated chemical 12 is an oxygen source, such as a percarbonate, a perborate, or a peroxide (e.g., hydrogen peroxide), and the second concentrated chemical is an oxygen catalyst, a dilute solution of the oxygen source chemical may first be generated in container 16. This dilute solution may then be applied on the oxygen catalyst, e.g., causing a reaction to generate a peracid that drops down into container 16. Were the oxygen catalyst first added to container 16 followed by the oxygen source chemical, the oxygen solution may not react to the same extent with the oxygen catalyst and/or excess oxygen catalyst may remain in container 16 after reaction.

Figure 3:
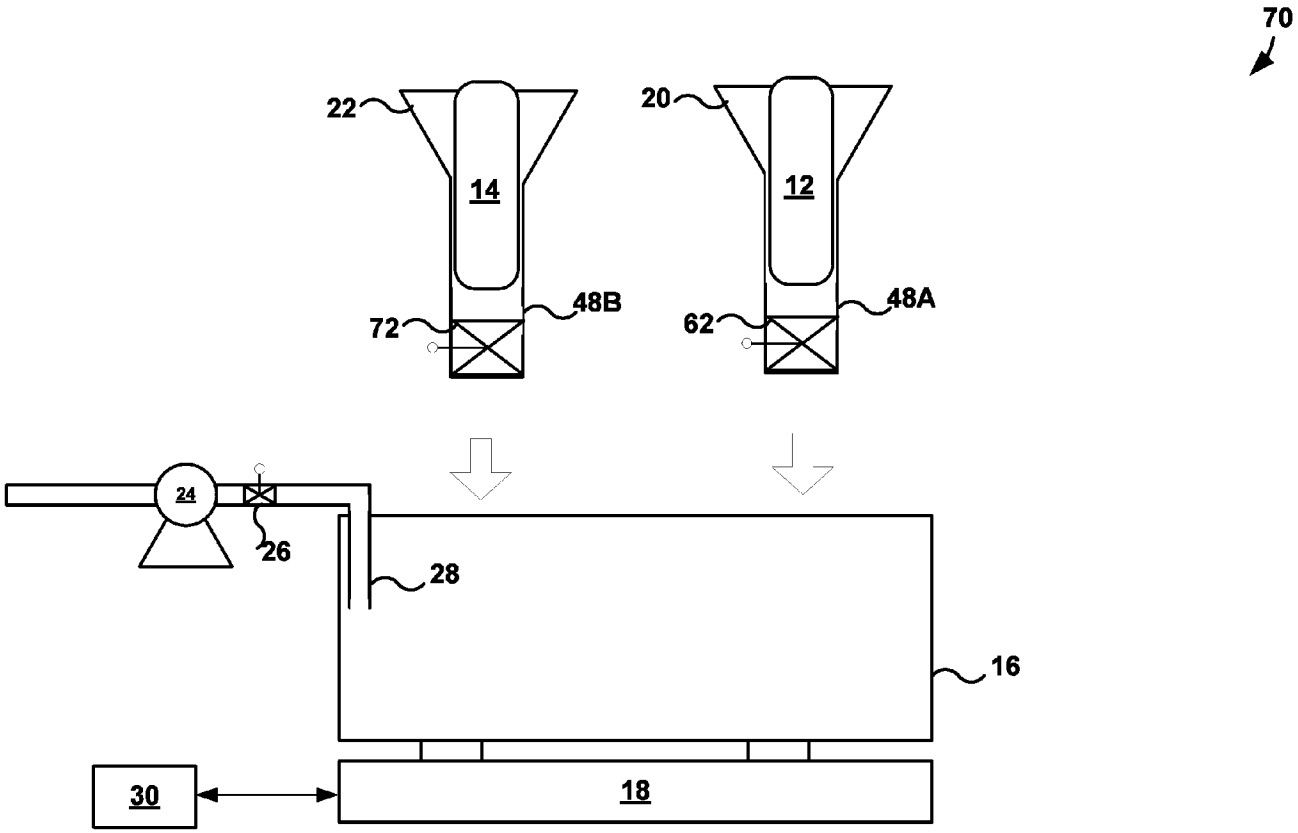
FIG. 3 is an illustration of another example chemical dilution system that may be used to prepare a dilute chemical solution using multiple concentrated chemicals.

FIG. 3 is a diagram of another example chemical dilution system 70 that prepares a requested dilute chemical solution from first concentrated chemical 12 and second concentrated chemical 14. Example chemical dilution system 70 in FIG. 3 is the same as example system 60 in FIG. 2 except that second concentrated chemical 14 is also a liquid phase product rather than a solid phase product. When second concentrated chemical 14 is provided as liquid product, second reservoir 22 is also selected to contain a liquid rather than a solid and may be, e.g., a tank, a tote, or a bottle.

Second reservoir 22 in chemical dilution system 70 includes an electronically controllable valve 72 positioned to control liquid flow out of second reservoir 22 via outlet 48B. Valve 72, which may be any of the types of valves discussed above with respect to FIG. 1, can be communicatively coupled to controller 30. In response to receiving a dispense request, controller 30 can control valve 72 to dispense a target amount of second concentrated chemical 14 into container 16. For example, when controller 30 opens valve 72, the force of gravity may cause second concentrated chemical 14 to dispense into container 16. Controller 30 can hold valve 72 open until feedback from weighing device 18 indicates that a target amount of second concentrated chemical 14 has entered container 16, at which point the controller closes the valve. In other examples, controller 30 controls a pump or other fluid delivery device to control addition of second concentrated chemical 14 from second reservoir 22 to container 16.

During operation, controller 30 may receive a dispense request requesting preparation of a requested amount of a diluted chemical solution. From the dispense request, controller 30 may determine a target weight of the diluent required to prepare the requested dilute chemical solution, determine a target weight of the first concentrated chemical 12 required to prepare the dilute chemical solution, and determine a target weight of the second concentrated chemical 14 required to prepare the dilute chemical solution. To prepare the solution, controller 30 can activate diluent pump 24 and open valve 26 to fill container 16 with diluent until feedback from weighing device 18 indicates that a target amount of diluent is in the container. Controller 30 controls addition of first concentrated chemical 12 to container 16, e.g., by opening controllable valve 62 so as to cause the first concentrated chemical to discharge under the force of gravity into the container via outlet 48A. When feedback from weighing device 18 indicates that a target amount of the first concentrated chemical has been added to the container, controller 30 may close electronically controllable valve 62. Controller 30 further controls addition of second concentrated chemical 14 to container 16, e.g., by opening controllable valve 72 so as to cause the second concentrated chemical to discharge under the force of gravity into the container via outlet 48B. When feedback from weighing device 18 indicates that a target amount of the second concentrated chemical has been added to the container, controller 30 may close electronically controllable valve 62. In this manner, chemical dilution system 70 can prepare a requested dilute chemical solution from a plurality of concentrated liquid chemicals.

During operation of the chemical dilution system (10, 60, 70), controller 30 receives information concerning a weight of container 16 and the contents thereof and controls addition of diluent, first concentrated chemical 12, and second concentrated chemical 14 based on the received weight information. For example, in response to receiving a dispense request specifying an amount of a dilute chemical solution to be prepared and/or a concentration of a chemical solution to be prepared and/or a chemical formulation of a chemical solution to be prepared, controller 30 may determine a target amount of diluent to add to container 16. Controller 30 may further determine a target amount of first concentrated chemical 12 to add to container 16 and a target amount of second concentrated chemical 14 to add to the container. The target amounts of diluent and concentrated chemicals may be values representing the amount of mass of each component intended to be added to container 16 in order to prepare the requested dilute chemical solution.

Controller 30 can control addition of diluent, first concentrated chemical 12, and second concentrated chemical 14 to container 16 by adding each respective component to the container until a signal received from weighing device 18 indicates that the mass of each component added to the container equals the target amount for that respective component. Because chemical dilution system (10, 60, 70) prepares a requested dilute chemical solution based on weight, the accuracy with which the solution is prepared may depend on the ability of weighing device 18 to accurately measure the contents of container 16.

In some examples, the chemical dilution system (10, 60, 70) has a conduit that extends down into container 16 so that the conduit is surrounded by liquid and submerged in the liquid to an increasing extent as the liquid level in the container increases. For example, FIG. 4 shows chemical dilution system 10 of FIG. 1 with example increasing levels of liquid in container 16. Pick-up conduit 34 extends down into container 16. At a first liquid level 100, pick-up conduit 34 is submerged from the bottom of the conduit to liquid level 100 along its major length a distance 102. Pick-up conduit 34 may be submerged in that the liquid surrounds and is in contact will all surfaces of the conduit below the liquid level. At a second liquid level 104 greater than first liquid level 100, pick-up conduit 34 is submerged along its major length a distance 104, which is greater than the distance 102. Although not illustrated in FIG. 4, chemical dilution system 10 may or may not have other conduits extending down into container 16, such as conduits extending from outlet 48A and/or 48B down into the container.

Applicant has found that, in some examples, a conduit extending into a container in which a dilute chemical solution is prepared, such as container 16, can cause an error in the mass determined by weighing device 18. Without wishing to be bound by any particular theory, it is believed that the volume of fluid displaced by the conduit extending into the container can cause weighing device 18 to over weigh the contents of the container. For example, the conduit extending into the container may cause a buoyancy effect so that weighing device 18 over weighs the contents of container 16 by an amount equal to the volume of liquid displaced by the conduit multiplied by the density of the fluid. As the liquid height of the container progressively increases, the volume of fluid displaced by the conduit may progressively increase, thereby increasing the magnitude with which weighing device 18 over weighs the contents of container 16.

Controller 30 may store calibration information so as to help correct weight measurements made by weighing device 18. Upon receiving measured weight data from weighing device 18, controller 30 can apply the calibration information to the measured weight data to generate calibrated weight data. Controller 30 can then compare the calibrated weight data to target weight values for the different constituent components of the dilute chemical solution, e.g., so as to determine when to start and/or stop adding the constituent components to container 16.

Information for calibrating data received from weighing device 18 may be stored in the form of look-up tables, equations, ratios, or any other suitable form. In one example, the calibration information takes the form of the following equation:

$$\text{Weight}_{Calibrated}=\text{Weight}_{measured}+(\text{Conduit}_{OD}-\text{Conduit}_{ID})*\text{Liquid Height}*\text{Density}$$

In the equation above, $\text{Weight}_{Calibrated}$ is the calibrated weight determined by controller 30 and $\text{Weight}_{measured}$ is the measured weight received from weighing device 18. In addition, $\text{Conduit}_{OD}$ is the outer diameter of the conduit extending into the container, $\text{Conduit}_{ID}$ is the inner diameter of the conduit, Liquid Height is the length of the conduit submerged in the liquid, and Density is the density of the liquid in the container.

The difference between $\text{Conduit}_{OD}$ and $\text{Conduit}_{ID}$ is the wall thickness of the conduit extending into container 16. When this difference is multiplied by the length of the conduit submerged in the liquid, controller 30 determines the volume of fluid displaced by the conduit. Controller 30 may determine the liquid height, e.g., from a liquid level sensor, by reference to calibration data correlating a measured weight of the contents of container 16 to a measured liquid height, or any other suitable technique. By further multiplying the density of the liquid (which may be assumed to be 1 kg/L in some examples) by the volume of fluid displaced by the fluid conduit, controller 30 can determine an amount by which to decrease the measured weight received from weighing device 18 so as to correct the measured weight.

In another example, controller 30 multiplies the measured weight received from weighing device 18 by a correction factor determined during a calibration procedure and stored in a memory associated with the controller. FIG. 5 is a block diagram illustrating an example calibration technique that may be performed by a chemical dilution system (10, 60, 70) to determine a calibration factor. In the example technique, container 16 is filled with a known mass of a liquid (200). The mass of the liquid may be determined using a calibrated device prior to introducing the liquid into container 16. The mass of the liquid in container 16 is then measured using weighing device 18 to determine a measured mass of the liquid (202). Additional liquid is added to container 16 so that additional measurements are taken as pick-up tube 34 is submerged to an increasing extent in container 16 (204). When a suitable number of data points (e.g., a statistically significant number of data points) are collected, a relationship is determined between the known mass of liquid introduced into container 16 and a measured mass of the liquid (206).

In one example, the known mass of liquid introduced into container 16 is plotted on a y-axis of a graph and the corresponding measured mass of the liquid is plotted on an x-axis of the graph. Controller 30 or another processing device may then fit a curve to the data points to determine a correction factor for generating calibrated weight data. In one example, the curve is a single order equation having the form y=m*x+b, where y is the calibrated weight, x is the measured weight, m is the slope of the curve, and b is the intercept of the curve. The slope of the curve "m" can be stored in a memory associated with controller 30 as a correction factor and used to adjust (e.g., decrease) container weight information measured by weighing device 18 during operation of chemical dilution system (10, 60, 70). In these examples, the intercept "b" can also be stored in the memory associated with controller 30 and added to the product of the measured weight multiplied by the correction factor "m." In other examples, the curve may be a higher order polynomial.

The chemical dilution system (10, 60, 70) produces a dilute chemical solution in response to receiving a dispense request. The dispense request may contain information concerning an amount of the dilute chemical solution to be prepared, a concentration of one or more chemical agents in the solution, and/or a chemical formulation of the solution. The dispense request may be entered via a user interface or may be stored in a controller memory. For example, the chemical dilution system (10, 60, 70) may include a user interface that presents a variety of preprogrammed dilute chemical solutions from which the user may select. As another example, the user interface may permit the user to enter parameters (e.g., volume, weight, and/or concentration of the requested dilute chemical solution) for a customized solution. As another example, the system may be programmed to automatically generate the dilute chemical solution(s) of desired volume(s) and concentration(s) at prescheduled times or at periodic intervals. Once the requested amount and the requested concentration of chemical agent(s) in the dilute chemical solution are known, controller 30 controls the various valve(s) and pump(s) in the system to prepare the requested solution, which is collected in container 16.

Figure 6:
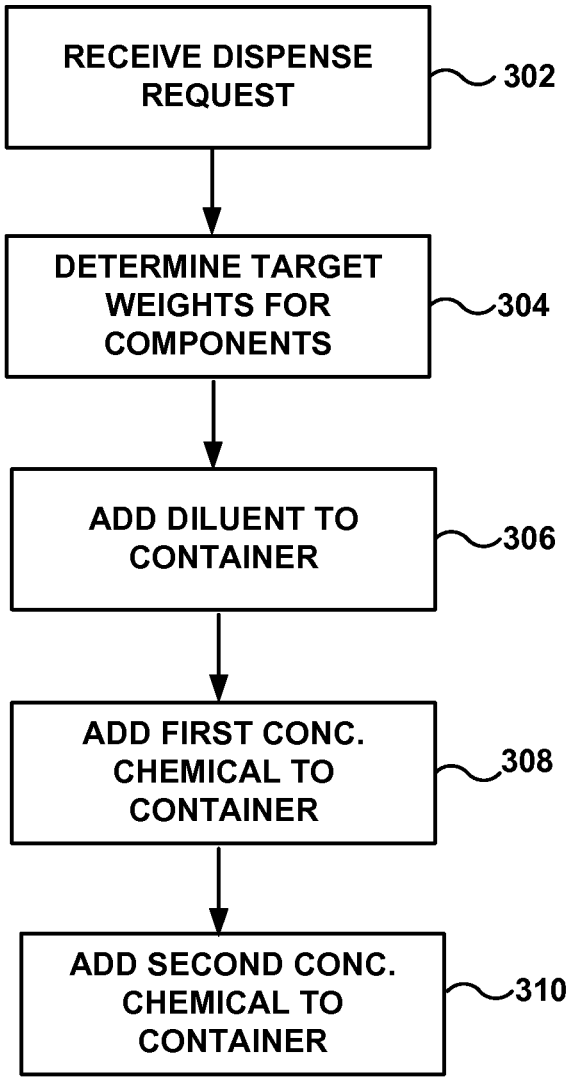
FIG. 6 is a block flow diagram of an example technique for preparing a dilute chemical solution.

FIG. 6 is a block diagram illustrating an example technique that may be performed by a chemical dilution system (10, 60, 70) to prepare a dilute chemical solution. A dispense request is received requesting preparation of a dilute chemical solution (302). The dispense request may be received at controller 30 via a user interface associated with the controller or from a memory associated with the controller. The dispense request may specify an amount of dilute amount of the dilute chemical solution to be prepared, a concentration of one or more chemical agents in the solution, and/or a chemical formulation of the solution. In response to receiving the request, a controller (e.g., controller 30) determines a target amount of diluent, a target amount of first concentrated chemical 12, and a target amount of second concentrated chemical 14 to add to container 16 to prepare the requested solution (304).

For example, if the requested amount (volume and/or weight) of the dilute chemical solution and the requested concentration each of the first concentrated chemical 12 and second concentrated chemical 14 of the solution are known, the target amount (e.g., weight) of chemical product required to prepare the requested solution may be determined as follows:

$$\text{First Conc. Chemical}_{target}\ (g)=\text{First Conc. Chemical}_{requested}\ (g/L)*\text{Vol. Solution request (L)}$$

$$\text{Sec. Conc. Chemical}_{target}\ (g)=\text{Sec. Conc. Chemical}_{requested}\ (g/L)*\text{Vol. Solution request (L)}$$

$$\text{Diluent}_{target}\ (g)=\text{Vol. Solution}_{request}\ (L)*\text{Density Solution}\ (g/L)-\text{First Conc. Chemical}_{target}\ (g)-\text{Sec. Conc. Chemical}_{target}\ (g)$$

In the equations above, First Conc. $\text{Chemical}_{target}$ (g) is the target amount of first concentrated chemical 12, First Conc. $\text{Chemical}_{requested}$ (g/L) is the concentration of the first concentrated chemical 12 requested to be in the dilute chemical solution per the dispense request, and Vol. $\text{Solution}_{request}$ (L) is the volume of dilute chemical solution requested to be prepared with the dispense request. In addition, Sec. Conc. $\text{Chemical}_{target}$ (g) is the target amount of second concentrated chemical 14 and Sec. Conc. $\text{Chemical}_{requested}$ (g/L) is the concentration of the second concentrated chemical 14 requested to be in the dilute chemical solution per the dispense request. Also, $\text{Diluent}_{target}$ (g) is the target amount of diluent and Density Solution (g/L) is the density of the dilute chemical solution to be prepared per the dispense request (which may be assumed to be a given value, for example, 1 kg/L).

As another example, such as where first concentrated chemical 12 and second concentrated chemical 14 react together to form a third compound, a dispense request may specify a requested amount (volume and/or weight) of the dilute chemical solution to be prepared and a requested concentration of the third compound to be in the dilute chemical solution. The requested solution may be determined as follows:

$$\text{Third Comp.}_{target}\ (mol)=\text{Third Comp.}_{requested}\ (g/L)*\text{Vol. Solution}_{request}\ (L)*MW_{third\ compound}\ (mol/g)$$

$$\text{First Conc. Chemical}_{target}\ (g)=\text{Third Comp.}_{target}\ (mol)*\text{Stoichiometric Ratio}_{First\rightarrow Third}*MW_{first\ conc.\ chemical}\ (g/mol)$$

$$\text{Second Conc. Chemical}_{target}\ (g)=\text{Third Comp.}_{target}\ (mol)*\text{Stoichiometric Ratio}_{Second\rightarrow Third}*MW_{second\ conc.\ chemical}\ (g/mol)$$

$$\text{Diluent}_{target}\ (g)=\text{Vol. Solution}_{request}\ (L)*\text{Density Solution}\ (g/L)-\text{First Conc. Chemical}_{target}\ (g)-\text{Sec. Conc. Chemical}_{target}\ (g)$$

In the equations above, Third $\text{Comp.}_{target}$ (mol) is the target number of moles of the third compound requested to be in the dilute chemical solution per the dispense request, Third $\text{Comp.}_{requested}$ (g/L) is the concentration of the third compound requested to be in the dilute chemical solution, Vol. $\text{Solution}_{request}$ (L) is the volume of dilute chemical solution requested to be prepared with the dispense request, and $MW_{third\ compound}$ (mol/g) is the molecular weight of the third compound. In addition, First Conc. $\text{Chemical}_{target}$ (g) is the target amount of first concentrated chemical 12, Stoichiometric $\text{Ratio}_{First\rightarrow Third}$ is the number of moles of first concentrated chemical 12 required to be added to second concentrated chemical 14 to generate one mole of the third compound, and $MW_{first\ conc.\ chemical}$ (g/mol) is the molecular weight of the first concentrated chemical. Also, Second Conc. $\text{Chemical}_{target}$ (g) is the target amount of second chemical 14, Stoichiometric $\text{Ratio}_{Second\rightarrow Third}$ is the number of moles of second concentrated chemical 14 required to be added to first concentrated chemical 12 to generate one mole of the third compound, and $MW_{second\ conc.\ chemical}$ (g/mol) is the molecular weight of the second concentrated chemical. $\text{Diluent}_{target}$ (g) is the target amount of diluent and Density Solution (g/L) is the density of the dilute chemical solution to be prepared per the dispense request (which may be assumed to be a given value, for example, 1 kg/L).

Once the target weight of diluent, first concentrated chemical 12, and second concentrated chemical 14 is determined (304), controller 30 controls addition of the diluent to container 16 (306). Controller 30 may activate diluent delivery pump 24 and open valve 26 to dispense diluent into container 16 until feedback received from weighing device 18 indicates that the weight of diluent in the container equals the target weight of the diluent. For example, controller 30 may receive measured weight information from weighing device 18 concerning the weight of liquid in container 16, adjust the weight information (e.g., as described above with respect to FIGS. 4 and 5) to generate calibrated weight information, and compare the calibrated weight information to determine when the target weight of diluent is dispensed into container 16. When the target weight is reached, controller 30 can deactivate diluent delivery pump 24 and close valve 26.

Controller 30 further controls addition of first concentrated chemical 12 to container 16 (308). In one example, controller 30 activates fluid delivery pump 32 and opens valve 38 so as to draw diluent from container 16 and spray the diluent onto the concentrated chemical. In another example, controller 30 opens valve 62 so as to dispense the concentrated chemical. In either example, first concentrated chemical 12 is added to container 16. Controller 30 may control addition of first concentrated chemical 12 to container 16 until feedback received from weighing device 18 indicates that the weight of the first concentrated chemical in the container equals the target weight of the chemical. For example, controller 30 may receive measured weight information from weighing device 18 concerning the weight of liquid in container 16, adjust the weight information (e.g., as described above with respect to FIGS. 4 and 5) to generate calibrated weight information, then determine the portion of the measured weight attributable to first concentrated chemical 12. For example, controller 30 may subtract the weight of the diluent from the calibrated weight information to determine the weight of the first concentrated chemical in the container. The weight of the diluent may be the measured weight of the diluent (e.g., determined by weighing device 18 after dispensing the diluent into the container but prior to dispensing first concentrated chemical 12) or the target weight of the diluent. In either case, controller 30 can compare the determined weight of first concentrated chemical 12 to the target weight for the chemical to determine when the target weight is added into container 16. When the target weight is reached, controller 30 can deactivate fluid delivery pump 32, close valve 38, close valve 62, and/or take suitable other action.

Controller 30 controls addition of second concentrated chemical 14 to container 16 (310). In one example, controller 30 activates fluid delivery pump 32 and opens valve 42 so as to draw diluent from container 16 and spray the diluent onto the concentrated chemical. In another example, controller 30 opens valve 72 so as to dispense the concentrated chemical. In either example, second concentrated chemical 14 is added to container 16. Controller 30 may control addition of second concentrated chemical 14 to container 16 until feedback received from weighing device 18 indicates that the weight of the second concentrated chemical in the container equals the target weight of the chemical. For example, controller 30 may receive measured weight information from weighing device 18 concerning the weight of liquid in container 16, adjust the weight information (e.g., as described above with respect to FIGS. 4 and 5) to generate calibrated weight information, then determine the portion of the measured weight attributable to second concentrated chemical 14. For example, controller 30 may subtract the weight of the diluent and the weight of the first concentrated chemical from the calibrated weight information to determine the weight of the second concentrated chemical in the container. The weight of the diluent and the first concentrated chemical may be the measured weight of the components (e.g., determined by weighing device 18 after dispensing the components into the container but prior to dispensing second concentrated chemical 14) or the combined weight of the target weight of the diluent and the target weight of the first concentrated chemical. In either case, controller 30 can compare the determined weight of second concentrated chemical 14 to the target weight for the chemical to determine when the target weight is added into container 16. When the target weight is reached, controller 30 can deactivate fluid delivery pump 32, close valve 43, close valve 72, and/or take suitable other action.

Diluent, first concentrated chemical 12, and second concentrated chemical 14 can be added to container 16 at any suitable times and any suitable rates. In different examples, one or more of the components (e.g., all of the components) may be added to container 16 over a given period of time (e.g., a timed dispense mode), in a single shot (e.g., a single-shot dispense mode), in multiple shots (e.g., multiple-shot mode) or other acceptable dispense modes. Additional details concerning example dispense modes that may be used to dispense diluent, first concentrated chemical 12, and/or second concentrated chemical 14 can be found in US Patent Publication No. 2011/0284090, the entire contents of which are incorporated herein by reference.

The examples described herein may be used to prepare use solutions having use in cleaning applications such as medical instrument cleaning, food processing, warewashing or laundry. However, it is to be recognized and understood that the techniques described herein have usefulness in other applications as well, and that the disclosure is not limited in this respect.

The techniques described in this disclosure, including functions performed by a controller, control unit, or control system, may be implemented within one or more of a general purpose microprocessor, digital signal processor (DSP), application specific integrated circuit (ASIC), field programmable gate array (FPGA), programmable logic devices (PLDs), or other equivalent logic devices. Accordingly, the terms "processor" or "controller," as used herein, may refer to any one or more of the foregoing structures or any other structure suitable for implementation of the techniques described herein.

The various components illustrated herein may be realized by any suitable combination of hardware, software, firmware. In the figures, various components are depicted as separate units or modules. However, all or several of the various components described with reference to these figures may be integrated into combined units or modules within common hardware, firmware, and/or software. Accordingly, the representation of features as components, units or modules is intended to highlight particular functional features for ease of illustration, and does not necessarily require realization of such features by separate hardware, firmware, or software components. In some cases, various units may be implemented as programmable processes performed by one or more processors or controllers.

Any features described herein as modules, devices, or components may be implemented together in an integrated logic device or separately as discrete but interoperable logic devices. In various aspects, such components may be formed at least in part as one or more integrated circuit devices, which may be referred to collectively as an integrated circuit device, such as an integrated circuit chip or chipset. Such circuitry may be provided in a single integrated circuit chip device or in multiple, interoperable integrated circuit chip devices.

If implemented in part by software, the techniques may be realized at least in part by a computer-readable data storage medium (e.g., a non-transitory computer-readable storage medium) comprising code with instructions that, when executed by one or more processors or controllers, performs one or more of the methods and functions described in this disclosure. The computer-readable storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), embedded dynamic random access memory (eDRAM), static random access memory (SRAM), flash memory, magnetic or optical data storage media. Any software that is utilized may be executed by one or more processors, such as one or more DSP's, general purpose microprocessors, ASIC's, FPGA's, or other equivalent integrated or discrete logic circuitry.

The following example may provide additional details about a chemical dilution system in accordance with this disclosure.

EXAMPLE

Using an example chemical dilution system in accordance with the disclosure, a container was filled with increasing amounts of liquid having a known (i.e., actual) mass. The chemical dilution system had a pick-up tube extending down into the container so that the pickup tube was submerged to an increasing extent as the container filled with an increasing amount of water. The mass of the liquid in the container was measured using a weighing device positioned under the container to determine a measured mass of the liquid in the container. The measured mass was determined to be more than the known mass of the liquid, and the measurement error increased as the amount of liquid in the container increased.

Figure 7:
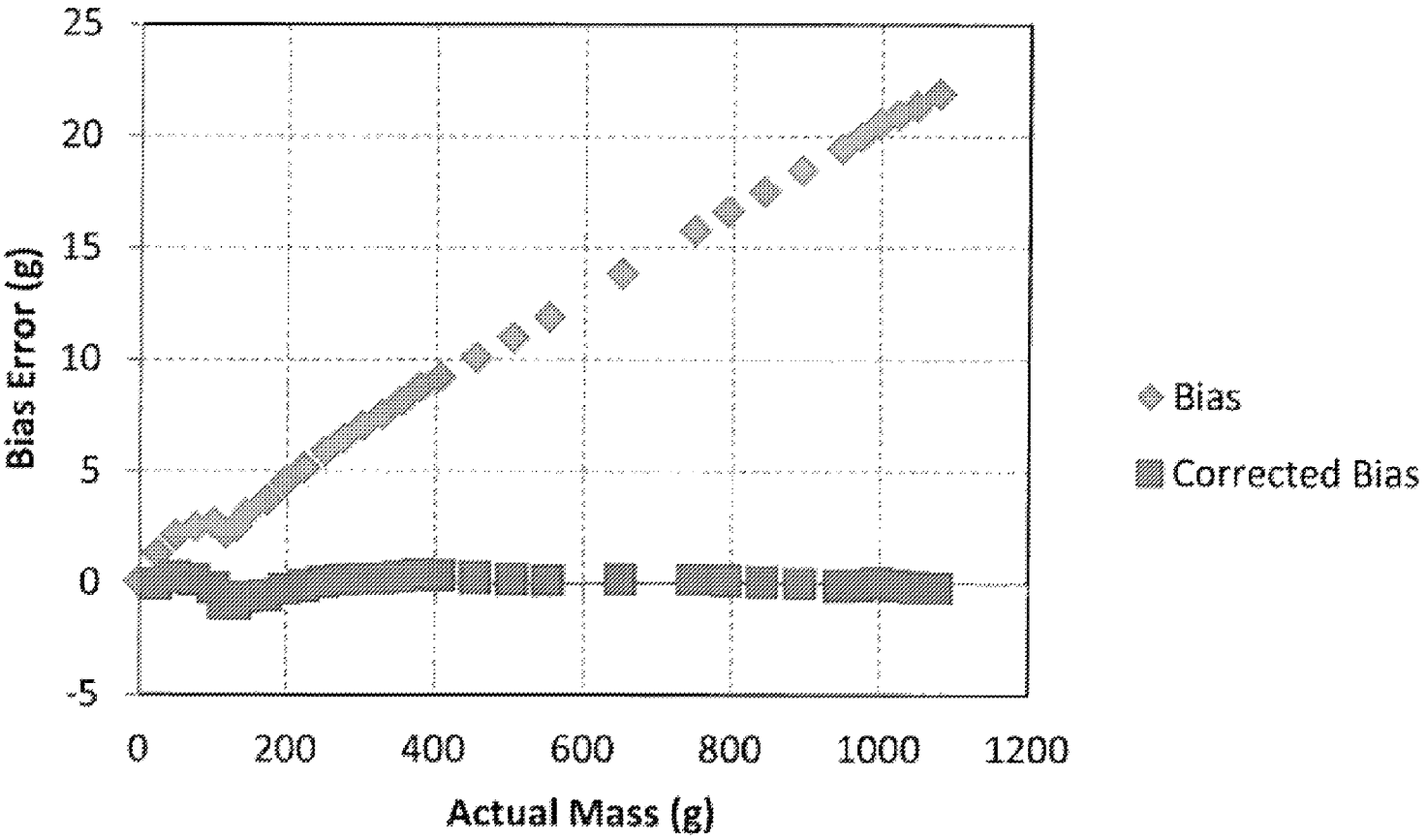
FIG. 7 is a plot of example weight measurement errors versus cumulative known liquid mass for an example chemical dilution system.

The measured mass and corresponding known mass values were plotted with the known mass values on the y-axis and the measured mass values on the x-axis. A single order equation having the form $y=m*x+b$ was fit to the curve. For the example system, "m" was determined to be 0.98. FIG. 7 is a plot of the measurement error for the example system plotted against the total amount of liquid introduced into the container. The y-axis of the plot shows the measurement error as bias, which is the measured mass of the liquid minus the known mass of the liquid. The positive bias indicates that the measuring device over weighed the contents of the container. The x-axis of the plot is the cumulative weight of liquid introduced into the container.

The measured mass of the liquid was multiplied by the correction factor "m" and the bias again determined by subtracting the known mass from the product of (measured mass×correction factor). This corrected bias is shown as a generally straight line around the zero bias point, indicating the correction factor removed the error in the measured mass values.

The invention claimed is:

1. A chemical dilution system comprising:

a first reservoir containing a first concentrated chemical;

a second reservoir containing a second concentrated chemical, wherein the second concentrated chemical is a solid state product and is different than the first concentrated chemical;

a container into which a target amount of a diluent required to prepare a diluted chemical solution is dispensed;

a weighing device positioned to obtain container weight information concerning a weight of the container and any contents thereof;

a fluid delivery system configured to extract a liquid solution from the container and apply the liquid solution on at least the second concentrated chemical so as to cause the second concentrated chemical to at least partially dissolve and enter the container; and a controller configured to receive a dispense request requesting preparation of a requested amount of the diluted chemical solution, determine the target amount of the diluent required to prepare the diluted chemical solution, determine a target weight of the first concentrated chemical required to prepare the diluted chemical solution, determine a target weight of the second concentrated chemical required to prepare the diluted chemical solution, control addition of the first concentrated chemical to the container based on the container weight information until the target weight of the first concentrated chemical is in the container, and control application of the liquid solution on the second concentrated chemical based on the container weight information until the target weight of the second concentrated chemical is in the container, wherein the fluid delivery system comprises a pump and a pick-up conduit extending from a suction side of the pump into the container so that the pick-up conduit is submerged to an increasing extent as the container fills with liquid, and wherein the controller is configured to receive container weight information from the weighing device and to correct an error caused by the pick-up conduit being submerged in the liquid by adjusting the container weight information based on a relationship between the container weight information and at least one known mass of liquid.

2. The system of claim 1, wherein the liquid solution applied on the second concentrated chemical includes both the diluent and the first concentrated chemical.

3. The system of claim 2, wherein the first concentrated chemical reacts with the second concentrated chemical when the liquid solution containing the diluent and the first concentrated chemical is applied on the second concentrated chemical.

4. The system of claim 1, wherein the first concentrated chemical is a solid state product and the fluid delivery system is further configured to extract the liquid solution from the container and apply the liquid solution on the first concentrated chemical so as to cause the first concentrated chemical to at least partially dissolve and enter the container.

5. The system of claim 1, wherein the relationship includes multiplying the received container weight information by a correction factor.

6. The system of claim 1, wherein the fluid delivery system comprises a pump, a first spray nozzle configured to spray the liquid solution on the first concentrated chemical, a second spray nozzle configured to spray the liquid solution on the second concentrated chemical, a first electronically controllable valve positioned to control liquid flow between the pump and the first spray nozzle, and a second electronically controllable valve positioned to control liquid flow between the pump and the second spray nozzle, and wherein the controller is configured to control application of the liquid solution to the first concentrated chemical and the second concentrated chemical by controlling actuation of the first electronically controllable valve and the second electronically controllable valve.

7. The system of claim 1, wherein the controller is configured to control addition of the first concentrated chemical to the container based on the container weight information by receiving container weight information from the weighing device, subtracting a weight of the diluent from the container weight information to determine a weight of the first concentrated chemical in the container, and comparing the determined weight of the first concentrated chemical to the target weight for the first concentrated chemical, and wherein the controller is configured to control application of the liquid solution on the second concentrated chemical based on the container weight information by receiving container weight information from the weighing device, subtracting a weight of the diluent and a weight of the first concentrated chemical from the container weight information to determine a weight of the second concentrated chemical in the container, and comparing the determined weight of the second concentrated chemical to the target weight for the second concentrated chemical.

8. The system of claim 1, wherein the container is removable from the chemical dilution system so that a user can manually move the container and any diluted chemical solution therein to an intended application location and apply the diluted chemical solution from the container to an intended application.

9. The system of claim 1, wherein the first reservoir contains a liquid and the controller is configured to control addition of the first concentrated chemical to the container by controlling an electronically controllable valve through which the liquid is dispensed.

10. The system of claim 1, wherein the first concentrated chemical is an oxygen source and the second concentrated chemical is an oxygen catalyst.

11. The system of claim 1, wherein the controller is further configured to initiate a timer upon preparation of the diluted chemical solution that counts an amount of time elapsed since the diluted chemical solution was prepared and further discard the diluted chemical solution from the container when the amount of time elapsed has exceeded a threshold.

12. A chemical dilution system comprising:

a first reservoir containing a first concentrated chemical;

a second reservoir containing a second concentrated chemical, wherein the second concentrated chemical is a solid state product and is different than the first concentrated chemical;

a container into which a target amount of a diluent required to prepare a diluted chemical solution is dispensed;

a weighing device positioned to obtain container weight information concerning a weight of the container and any contents thereof;

a fluid delivery system configured to extract a liquid solution from the container and apply the liquid solution on at least the second concentrated chemical so as to cause the second concentrated chemical to at least partially dissolve and enter the container; and a controller configured to:

determine a target weight of the first concentrated chemical required to prepare the diluted chemical solution, determine a target weight of the second concentrated chemical required to prepare the diluted chemical solution, determine the target amount of the diluent required to prepare the diluted chemical solution based on the target weight of the first concentrated chemical and the target weight of the second concentrated chemical, control addition of the diluent to the container based on the container weight information until the target amount of the diluent is in the container, control addition of the first concentrated chemical to the container based on the container weight information until the target weight of the first concentrated chemical is in the container by receiving container weight information from the weighing device, subtracting a weight of the diluent from the container weight information to determine a weight of the first concentrated chemical in the container, and comparing the determined weight of the first concentrated chemical to the target weight for the first concentrated chemical, and control application of the liquid solution on the second concentrated chemical based on the container weight information until the target weight of the second concentrated chemical is in the container by receiving container weight information from the weighing device, subtracting a weight of the diluent and a weight of the first concentrated chemical from the container weight information to determine a weight of the second concentrated chemical in the container, and comparing the determined weight of the second concentrated chemical to the target weight for the second concentrated chemical, wherein the fluid delivery system comprises a pump and a pick-up conduit extending from a suction side of the pump into the container so that the pick-up conduit is submerged to an increasing extent as the container fills with liquid, and wherein the controller is configured to receive container weight information from the weighing device and to correct an error caused by the pick-up conduit being submerged in the liquid by adjusting the container weight information based on a relationship between the container weight information and at least one known mass of liquid.

* * * * *